US007478578B2

(12) United States Patent
Kirkpatrick

(10) Patent No.: US 7,478,578 B2
(45) Date of Patent: Jan. 20, 2009

(54) COMMERCIAL AIRLINER MISSILE PROTECTION USING FORMATION DRONE AIRCRAFT

(75) Inventor: Philip L. Kirkpatrick, Oradell, NJ (US)

(73) Assignee: Honeywell International Inc., Morristown, NJ (US)

( * ) Notice: Subject to any disclaimer, the term of this patent is extended or adjusted under 35 U.S.C. 154(b) by 422 days.

(21) Appl. No.: 11/165,975

(22) Filed: Jun. 24, 2005

(65) Prior Publication Data

US 2008/0190274 A1 Aug. 14, 2008

(51) Int. Cl.
*B64D 1/04* (2006.01)

(52) U.S. Cl. ..... 89/1.11; 89/1.1; 244/1 R; 244/190; 342/13; 342/14

(58) Field of Classification Search ..... 89/1.11, 89/1.1; 244/1 R, 190; 342/13, 14
See application file for complete search history.

(56) References Cited

U.S. PATENT DOCUMENTS 3,131,887 A * 5/1964 Fairbanks ..... 244/3.11
6,487,500 B2 11/2002 Lemelson
6,626,397 B2 * 9/2003 Yifrach ..... 244/35 R
6,738,012 B1 5/2004 Kirkpatrick
7,053,812 B2 * 5/2006 Trainor ..... 342/14
2003/0136874 A1 7/2003 Gjerdrum
2005/0062638 A1 3/2005 Zeineh

FOREIGN PATENT DOCUMENTS

WO WO 2005/001374 A2 1/2005

OTHER PUBLICATIONS

Caffera, Paul J., "U.S. Jets Easy Target for Shoulder-Fired Missiles—Kanya Attack Highlights How Terrorists Might Down Plane Here", San Francisco Chronicle, Nov. 30, 2002, San Francisco, US.

* cited by examiner

*Primary Examiner*—John W Eldred
(74) *Attorney, Agent, or Firm*—Ingrassia, Fisher & Lorenz, P.C.

(57) ABSTRACT

A commercial airliner (100) controls and is flown in formation with a drone aircraft (200) that includes missile detection and diversion equipment (215) capable of protecting the airliner from a man portable missile (130).

20 Claims, 8 Drawing Sheets

COMMERCIAL AIRLINER MISSILE PROTECTION USING FORMATION DRONE AIRCRAFT

BACKGROUND OF THE INVENTION

1. Technical Field

The present invention relates to an apparatus and method for protecting commercial airliners from man portable missiles.

2. Background Art

There is a growing concern that terrorists will use shoulder-fired, heat-seeking missiles to shoot down commercial airliners. Many portable heat-seeking missiles are inexpensive, relatively easy to obtain on the black market and extremely dangerous. Afghan rebels used U.S.-supplied Stinger missiles to destroy Soviet jets and attack helicopters in the 1980s. Terrorists have recently tried to use older, Soviet-made SA-7 shoulder-fired missiles to bring down U.S. military aircraft in Saudi Arabia and an Israeli airliner in Kenya.

Neighborhoods or other areas where terrorists could hide and attack commercial jet airliners as they land or take off surround many of the world's civilian airports. Jets that routinely cruise at 500 mph or faster fly much more slowly near the ground. A Boeing 737 typically flies both take-off climb-out and landing approaches at 150-160 mph, for example. Even slow shoulder-fired missiles can fly almost 1,000 mph, more than fast enough to overtake a jet.

A heat-seeking missile operates much like a point-and-shoot camera. The operator aims at one of a plane's engines, which are heat sources, "locks on" the target for about six seconds, and fires. The missile has an infrared sensor that "sees" the aircraft's heat plume; a computer navigational system guides the weapon to an engine. A commercial pilot would almost never see a missile coming and could generally react only after the missile hit an engine or exploded nearby.

Certain US Air Force aircraft, such as C-17 cargo jets, have equipment to thwart attacks from portable heat-seeking missiles. It is known in the art to protect such aircraft by providing, on the aircraft, missile-detecting sensors coupled to a processor, which determines whether a missile is present, and flare and or chaff dispensers that explode flares or chaff to divert the missile away from the aircraft. However, the cost to install and maintain such equipment on many civilian aircraft would be very expensive, the missile detection algorithms are military sensitive knowledge, and it would be both unwise and unacceptable to install a pyrotechnic on a civilian aircraft.

Kirkpatrick (U.S. Pat. No. 6,738,012 B1) describes a sensor mounted on an airliner where this sensor provides raw data for processing at a ground station.

Zeineh (US Patent Application 20050062638) teaches that an incoming missile can be diverted by a towed retractable IR source.

There are roughly 5,000 commercial aircraft owned by U.S. carriers and 10,000 more in the rest of the world. There is a need to protect these commercial airliners from man portable missiles.

SUMMARY OF THE INVENTION

In accordance with my present invention, a protection drone aircraft or unmanned air vehicle (UAV) is flown in formation with a commercial airliner carrying passengers. This formation drone aircraft, which carries various missile detection and diversion equipment, is controlled by a wireless data link that is coupled directly into the airliner's flight control system. The formation drone aircraft can accompany the airliner through either an approach or departure protection zone associated with a particular airport.

When the formation drone determines that a missile is being viewed by a missile sensor head, the formation drone lays down a predetermined pattern of exploding flares to divert the missile away from the airliner, attempts to spoof the missile using laser countermeasures, or sacrifices itself to protect the airliner.

After the airliner either lands or departs the airport protected zone, control of the formation drone is returned to the airport control tower and the drone is made available to protect another airliner.

In a further embodiment of my invention, the airliner is also equipped with missile sensors and raw data from these sensors is transmitted to the formation drone aircraft. The formation drone aircraft includes onboard computing capability to combine both its own sensor data as well remote sensor data received from the airliner.

In yet a further embodiment of my invention, multiple formation drone aircraft are used to protect a particular airliner.

Precise airliner and formation drone positioning is accomplished by transmitting raw GPS data from the formation drone to the protected airliner. The protected airliner computes a differential GPS position for both itself and the drone where this position is used by the airliner flight control computer to control and position both itself and the formation drone aircraft.

LIST OF REFERENCE NUMBERS FOR THE MAJOR ELEMENTS IN THE DRAWING

Figure 1:
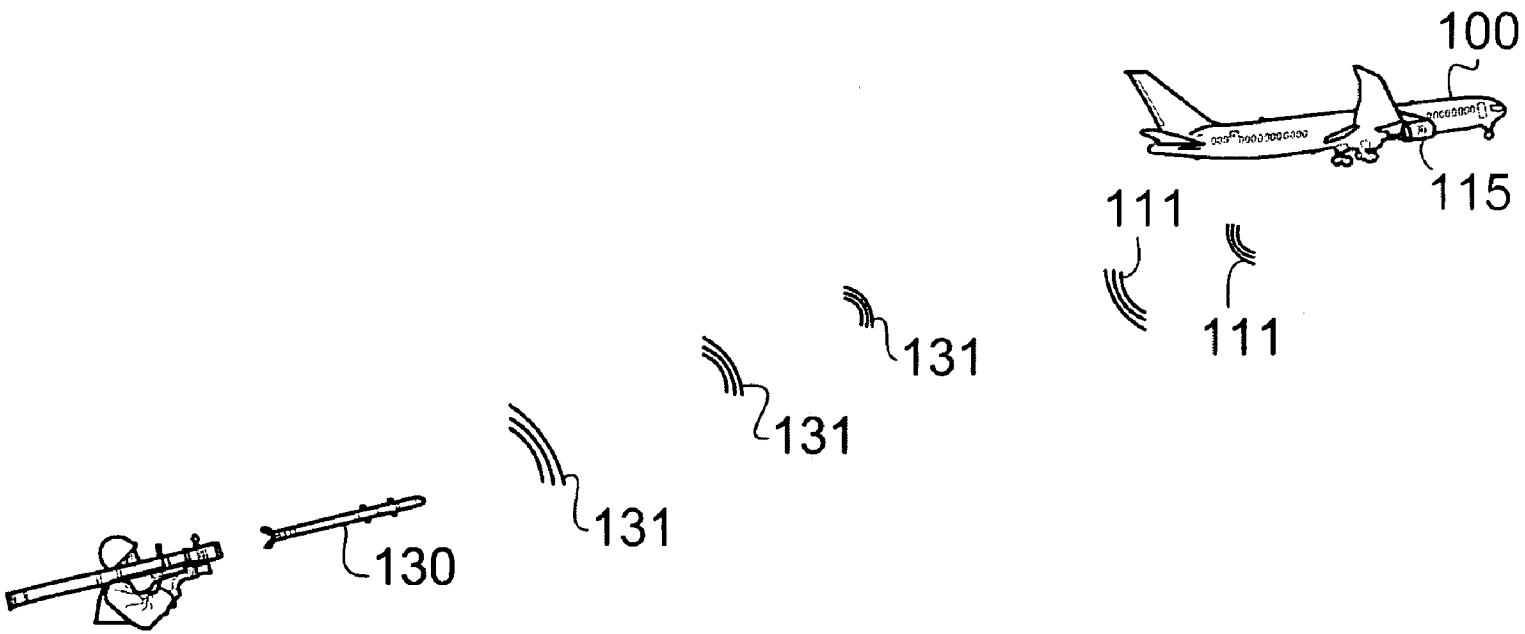
FIG. 1 PRIOR ART
FIG. 1 illustrates a commercial airliner which is being targeted by a man portable missile.

The following is a list of the major elements in the drawings in numerical

5 formation centroid (of airliner and drone aircraft formation)
10 airliner geometric reference plane
11 first airliner GPS antenna (on commercial airliner 100)
12 second airliner GPS antenna (on commercial airliner 100)
13 third airliner GPS antenna (on commercial airliner 100)
20 drone aircraft geometric reference plane
21 first drone GPS antenna (on drone aircraft 200)
22 second drone GPS antenna (on drone aircraft 200)
23 third drone GPS antenna (on drone aircraft 200)
50 formation geometric reference plane
60 wireless data link 60
61 first channel (wireless data link 60—airliner to drone aircraft)
62 second channel (wireless data link 60—drone aircraft to airliner)
70 airliner-drone aircraft combined flight control system
71 airliner flight control system
72 drone aircraft flight control system
100 airliner
111 first detectable characteristic (associated with airliner 100)
115 jet engine (p/o airliner 100)
130 man portable missile
131 second detectable characteristic (associated with missile 130)
150 flight control processor A (on airliner 100)
161 airliner data link receiver
162 airliner data link transmitter
171 airliner flight control sensors
173 airliner flight control actuators
200 drone aircraft
211 purposely misleading characteristic signal
213 flare dispenser (on drone aircraft 200)
214 exploded flare
215 infrared jammer (on drone aircraft 200)
250 flight control processor B (on drone aircraft 200)
251 countermeasures processor (on drone aircraft 200)
261 drone aircraft data link transmitter
262 drone aircraft data link receiver
271 drone aircraft flight control sensors
273 drone aircraft flight control actuators
710 step of computing formation centroid
720 step of computing formation geometric reference plane
730 step of stabilizing formation geometric reference plane
740 step of computing airliner geometric reference plane
745 step of computing drone aircraft geometric reference plane
750 step of stabilizing airliner geometric reference plane
755 step of stabilizing drone aircraft geometric reference plane
760 step of continuing to fly in formation (by repeating steps 710-755)
810 step of moving airliner to launch position
820 step of moving drone aircraft to launch position
830 step of taking control, by airliner, of drone aircraft flight controls
840 step of airliner on take-off trajectory in formation with drone aircraft
850 step of detecting missile launch by drone aircraft
860 step of activating missile countermeasures by drone aircraft
870 step of exiting airport protected zone by airliner
880 step of taking control, by air traffic control, of drone aircraft
X Cartesian coordinate—X
Y Cartesian coordinate—Y
Z Cartesian coordinate—Z

DESCRIPTION OF THE INVENTION

Mode(s) for Carrying Out the Invention

Referring first to FIG. 1, a commercial airliner 100, such as, for example, a Boeing 777 taking off from an airport runway is being fired on by a man portable missile 130. The airliner 100 has been targeted and is being tracked by the missile 130 based on a first detectable characteristic 111 associated with the airliner, such as the infrared (heat) signature of one of its jet engines 115. As the missile 130 travels toward airliner 100, it has associated with it a second detectable characteristic 131, such as, for example, the spectral content of its rocket engine plume or its own motion or radar cross-section.

Figure 2:
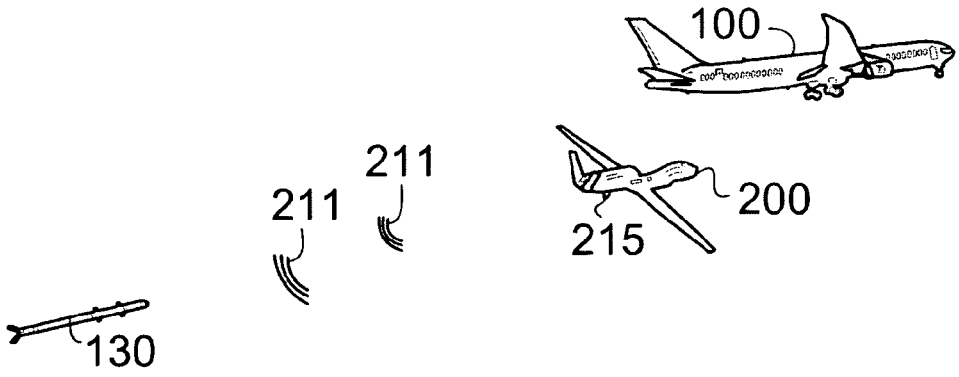
FIG. 2 shows the missile of FIG. 1 being diverted by an infrared jammer mounted on a drone aircraft in accordance with a first illustrative embodiment of my invention.
Figure 3:
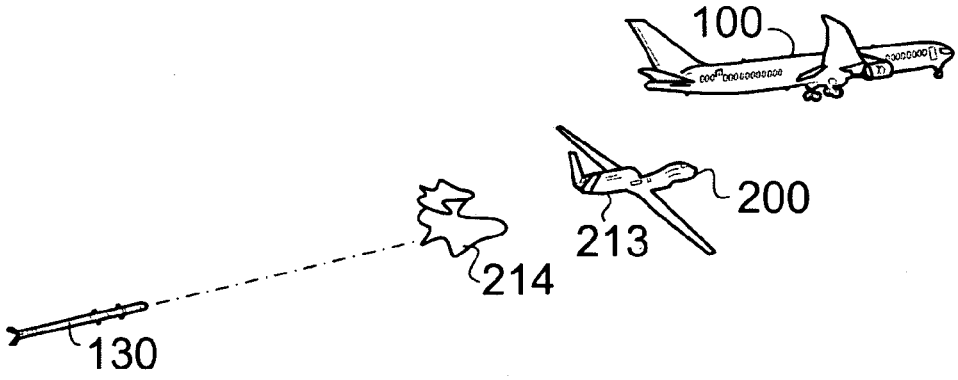
FIG. 3 shows the missile of FIG. 1 being diverted by an exploded flare launched from a drone aircraft in accordance with a second illustrative embodiment of my invention.

Referring now to FIGS. 2 and 3, the missile 130 has been diverted from its intended target, commercial airliner 100, such as toward a purposely misleading characteristic signal 211 in accordance with a first embodiment of my invention, or toward an exploded flare 214 in accordance with a second embodiment of my invention.

FIG. 2 shows this first embodiment, in which the purposely misleading characteristic signal 211 is an infrared signal that mimics the infrared signature of a jet engine and is being emitted from an infrared jammer 215 that is mounted on a drone aircraft 200. In another embodiment, the purposely misleading characteristic signal 211 is a false radar return that confuses an incoming radar-homing missile.

FIG. 3 shows the second embodiment of my invention in which the missile 130 has been diverted away the airliner 100 toward exploded flare 214, which has been released from a flare dispenser 213 that is mounted on a drone aircraft 200.

Figure 7:
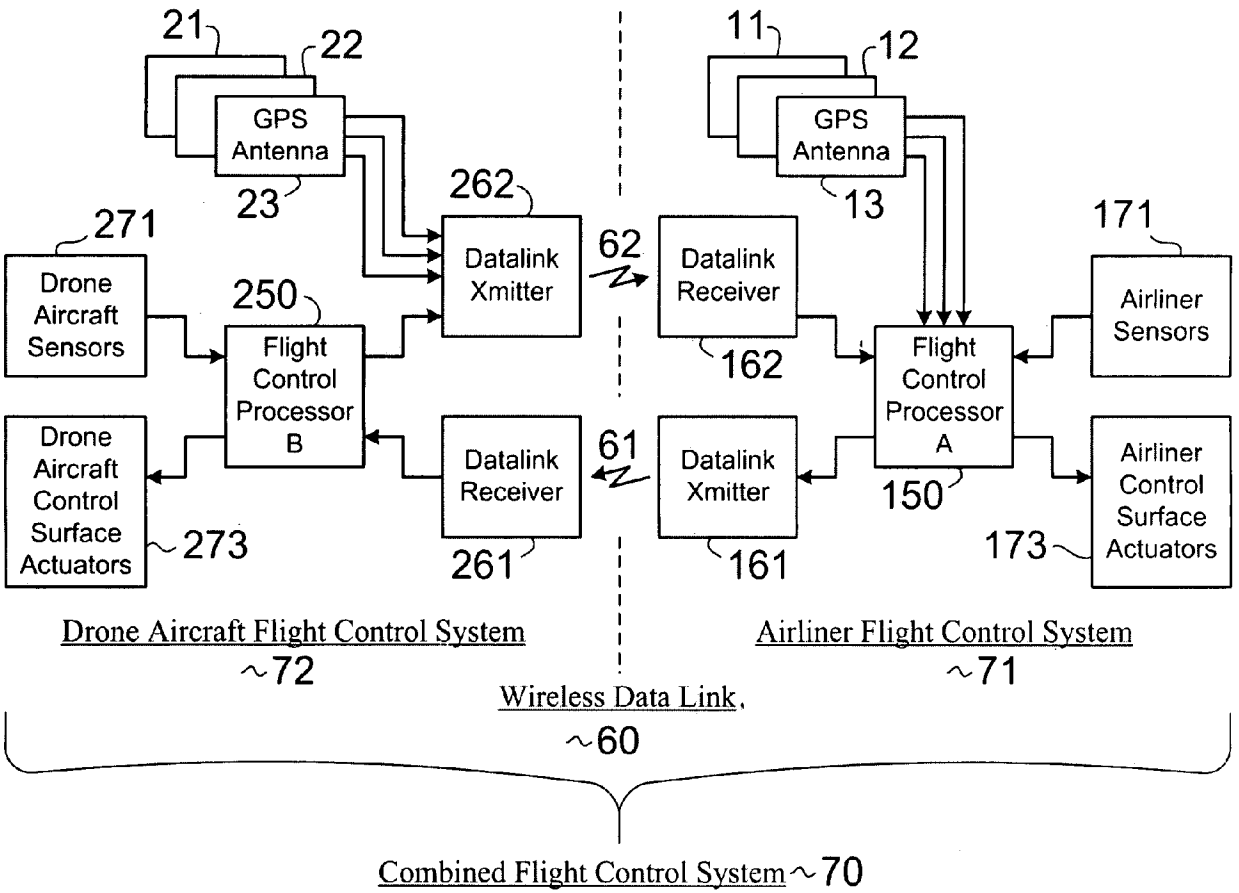
FIG. 7 is a functional block diagram illustrating an airliner-drone aircraft combined flight control system in accordance with my invention.

In both FIGS. 2 and 3, the drone aircraft 200 which is responsible for diverting the missile 130, is flying in formation with, and under the direct control of airliner 100. More specifically, as seen in FIG. 7, my invention teaches that a first fly-by-wire airliner flight control system 71 on airliner 100 and a second fly-by-wire drone aircraft flight control system 72 on drone aircraft 200 are connected by a wireless data link 60 are tightly coupled, such as at the inner-loop level, so as to form a airliner-drone aircraft combined flight control system 70. This airliner-drone aircraft combined flight control system 70 directly controls flight control surface actuators 173 and 273, such as ailerons, elevators, and rudders on both the airliner 100 and the drone aircraft 200.

Figure 4:
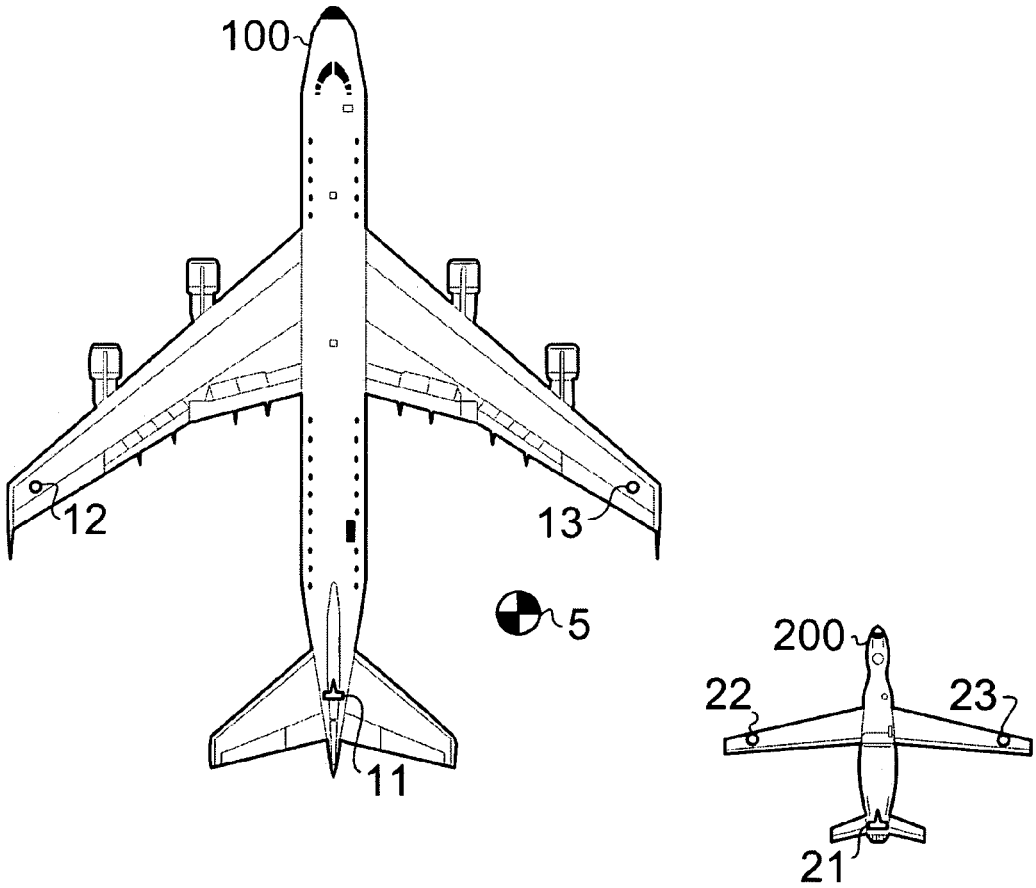
FIG. 4 depicts a commercial airliner and a drone aircraft, each equipped with GPS antennas and flying together in formation in accordance with my invention.

Refer now to FIG. 4, there is depicted a view looking down on commercial airliner 100 while it is flying in formation with drone aircraft 200. Shown mounted on airliner 100 are a first airliner GPS antenna 11, a second airliner GPS antenna 12, and a third airliner GPS antenna 13. Similarly, shown mounted on drone aircraft 200 are a first drone GPS antenna 21, a second drone GPS antenna 22, and a third drone GPS antenna 23. In addition, there is shown a formation centroid 5, which I am defining as the geometric reference point corresponding to the geographic center of all airliner and drone aircraft GPS antennas (11, 12, 13, 21, 22, and 23) within the formation. Further embodiments of my invention include more than one drone aircraft flying in formation with and controlled by a particular airliner.

I have determined that an appropriate arrangement of three GPS antennas, on an aircraft, such as providing that the antennas are spaced at a considerable distance (>5 meters) from each other and not allowing all three antennas to be collinear, will allow these antennas to each define a geometric reference point, where the three resulting geometric reference points can in turn be used to determine a geometric reference plane for the aircraft.

Figure 5:
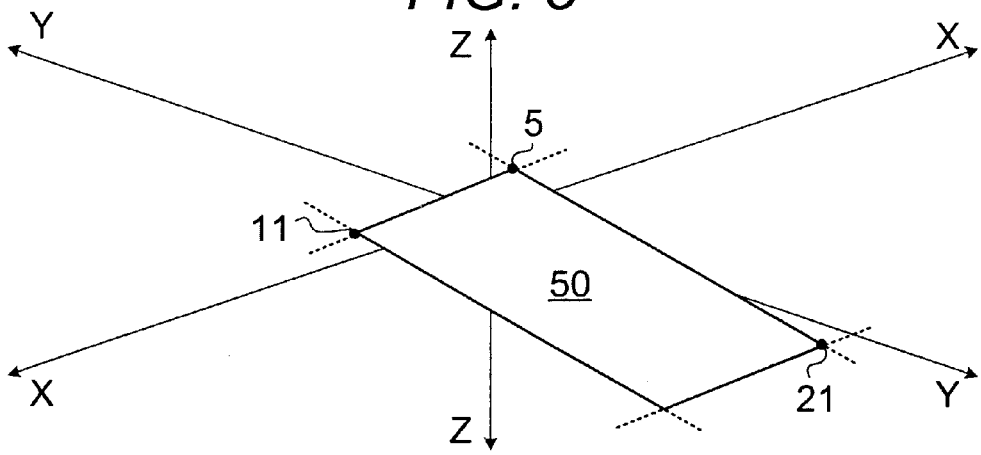
FIG. 5 depicts a geometric reference plane constructed from a formation centroid, a first airliner GPS antenna position and a first drone aircraft GPS antenna position in accordance with my invention.

Refer now to both FIGS. 4 and 5. FIG. 5 depicts a formation geometric reference plane 50, where this plane is defined by a first point (x1, y1, z1) being the geographical position of the formation centroid 5, a second point (x2, y2, z2) being the geographical position of first airliner GPS antenna 11, and a third point (x3, y3, z3) being the geographical position of the first drone aircraft GPS antenna 21. This definition is based on the mathematical principle that three non-collinear points in space define a plane in space. It is known that a geometric plane in space can be represented in various ways, such as in standard mathematical form:

$$Ax+By+Cz+D=0;$$

where X, Y, and Z are standard Cartesian coordinates and A, B, C, and D are numerical constants.

Figure 6:
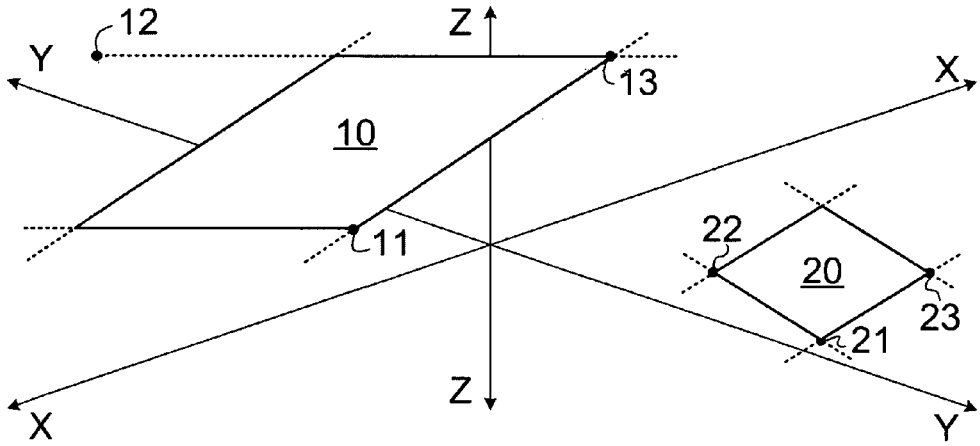
FIG. 6 depicts a geometric reference plane for the commercial airliner and a geometric reference plane for the drone aircraft, both of which are shown in FIG. 4.

Refer now to both FIGS. 4 and 6. FIG. 6 depicts a airliner geometric reference plane 10 for the commercial airliner 100 where this plane is defined by a first point (x1, y1, z1) being the geographical position of the first airliner GPS antenna 11, a second point (x2, y2, z2) being the geographical position of the second airliner GPS antenna 12, and a third point (x3, y3, z3) being the geographical position of the third airliner GPS antenna 13. FIG. 6 also depicts a drone aircraft geometric reference plane 20 for the drone aircraft 200 where this plane is defined by a first point (x1, y1, z1) being the geographical position of the first drone aircraft GPS antenna 21, a second point (x2, y2, z2) being the geographical position of the second drone aircraft GPS antenna 22, and a third point (x3, y3, z3) being the geographical position of the third drone aircraft GPS antenna 23.

FIG. 7 is functional block diagram of an airliner-drone aircraft combined flight control system 70 that is used to simultaneously control an airliner 100 and a formation drone aircraft 200 flying together in formation, such as is shown in FIGS. 2-4. This combined flight control system 70 is formed when an airliner flight control system 71, such as a modern digital 'fly-by-wire' control system based takes control of a drone aircraft flight control system 72 via a wireless data link 60. In a preferred embodiment, wireless data link 60 is secure, such as being encrypted, and hardened, such as being jam-resistant. In yet a further embodiment, a plurality redundant wireless data links are used to communicate between the airliner flight control system 71 and the drone aircraft flight control system 72.

On airliner 100, airliner sensors 171, such as air data sensors, inertial sensors, and actuator position sensors, provide inputs to flight control processor A 150, which is similar to a fly-by-wire computer familiar to those skilled in the art. Flight control processor A 150 accepts these sensor inputs, along with other inputs described below, and drives the airliner control surface actuators 173, such elevators (pitch), ailerons (roll), and rudders (yaw). Airliner sensor information from flight control processor A 150 and raw GPS data, such as down-converted intermediate frequency (IF) signals, from first airliner GPS antenna 11, second airliner GPS antenna 12, and third airliner GPS antenna 13 are transferred to a first data link transmitter 161.

First data link transmitter 161 converts its airliner input signals into a wireless format and transmits this data as a first channel 61, over wireless data link 60, from the airliner 100 to the drone aircraft 200, where it is received by a first data link receiver 261.

On drone aircraft 200, drone aircraft sensors 271, such as air data sensors, inertial sensors, and actuator position sensors provide inputs to flight control processor B 250, which is similar to a fly-by-wire computer familiar to those skilled in the art. Flight control processor B 250 accepts these sensor inputs, along with airliner input signals that are received by and forwarded from the first data link receiver 261, and drives the drone aircraft control surface actuators 273, such as elevators (pitch), ailerons (roll), and rudders (yaw). Drone aircraft sensor information from flight control processor B 250 and raw GPS data, such as down-converted intermediate frequency (IF) signals, from first drone aircraft GPS antenna 21, second drone aircraft GPS antenna 22, and third drone aircraft GPS antenna 13 are transferred to a second data link transmitter 262.

Second data link transmitter 262 converts its drone aircraft input signals into a wireless format and transmits this data as a second channel 62, over wireless data link 60, from the drone aircraft 200 to the airliner 100, where it is received by a second data link receiver 162. The second data link receiver 162 forwards the drone aircraft input signals to flight control processor A 150.

Advantageously, providing raw GPS antenna data from both the airliner GPS antennas 11, 12, and 13 and the drone aircraft GPS antennas 21, 22, and 23 directly to flight control processor A 150 allows flight control processor A 150 to compute both the absolute and differential GPS positions of these antennas relative to each other. As is known in the field of GPS surveying and familiar to those skilled in the art of real-time kinematics, very accurate differential positioning is possible by measuring both the number of cycles of the GPS carrier frequency as well as a carrier frequency phase shift phase shift, which is equivalent to a partial cycle. Advantageously, by measuring both full and partial carrier cycles, the geographic locations of the airliner and drone aircraft GPS antennas with respect to each other can be measured with a high level of accuracy such as +/−0.1 meter.

It will be appreciated by those skilled in the art that additional flight control sensor data, such as airspeed and roll rate for both the airliner 100 and drone aircraft 200 can be provided to flight control processor A 150 in order to allow for additional filtering of the computed GPS antenna positions.

Figure 8:
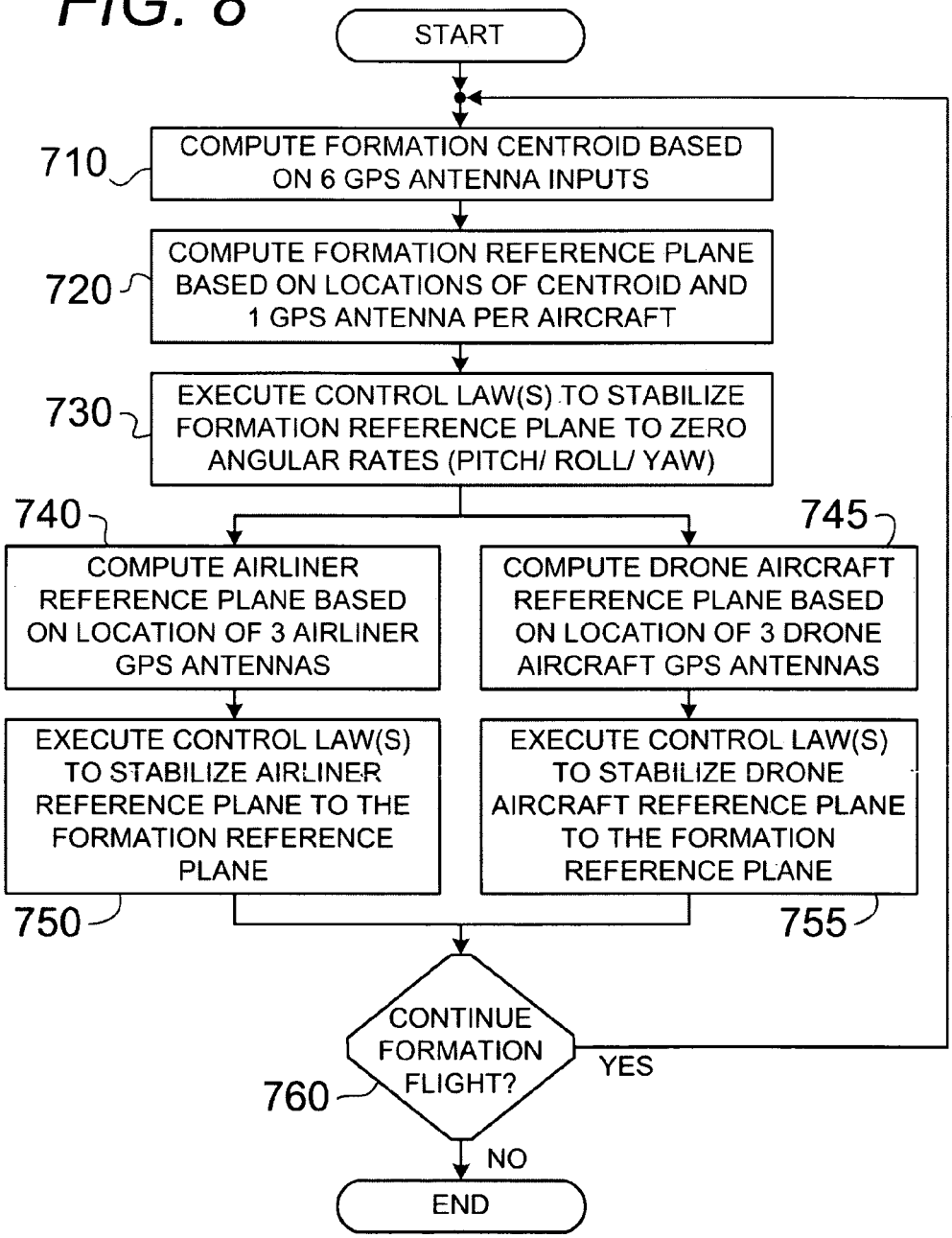
FIG. 8 is a flowchart that shows the steps of operating the airliner-drone aircraft combined flight control system of FIG. 7 according to an illustrative embodiment of my invention.

Refer now to FIG. 8 which shows steps of operating the airliner-drone aircraft combined flight control system of FIG. 7. I have discovered that the following method steps, as executed by a combination of an airliner and a drone aircraft flight control system, such as is illustrated in FIG. 7, advantageously operates these two aircraft in formation flight.

First, the geographical position of the formation centroid 5 is computed (step 710) based on GPS radio frequency signals received at each of the airliner GPS antennas (11, 12, 13) and each of the drone aircraft GPS antennas (21, 22, 23) using techniques known to those skilled in the art of GPS signal processing. The differential geographic position the airliner GPS antennas (11, 12, 13) and each of the drone aircraft GPS antennas (21, 22, 23), with respect to the centroid 5 is then computed using other techniques known to those skilled in the art of GPS signal processing.

Next, the formation geometric reference plane 50 (shown in FIG. 5) is computed (step 720), from the geographical position of the formation centroid 5 and one GPS antenna position on each of the airliner, such as the first airliner GPS antenna 11 and drone aircraft, such as the first drone aircraft GPS antenna 21. This computation is based on the mathematical principle that three non-collinear points in space define a plane in space. It will be apparent to those skilled in the art that the results of such a computation, as earlier described, could be to represent the equation of the formation geometric reference plane 50 in standard mathematical form:

$$Ax+By+Cz+D=0$$

It will also be appreciated by those skilled in the art that three orthogonal angular orientations of the formation geometric reference plane 50 with respect to the Earth can then be determined, for example heading (yaw), elevation (pitch), and heel (roll) angles.

A first set of control laws is executed (step 730) in the airliner-drone aircraft combined flight control system 70 in order to stabilize the formation geometric reference plane 50 to zero angular rates in one, two, or three of these orthogonal axes, such as for example in pitch, roll, and yaw.

It is known in the art to stabilize an aircraft by using control laws to drive angular rates, such as pitch rate or roll rate, to zero. This is a typical function on many aircraft autopilot systems. On these prior art systems, these angular rates are measured by a locally mounted aircraft sensors, such as turn rate gyros or inertial measurement units (IMU). My inventive aircraft formation stabilization system uses the angular positions and rates of the computed geometric reference planes, as shown in FIGS. 5-6, instead of such locally mounted sensors. Such locally mounted angular position and rate sensors may be used to smooth and augment the geographic position measurements associated with the geometric points defining these reference planes; however, it is important to note that my inventive concept bases the computation of the reference planes, including their orientations, on geographic position measurements and not on aircraft body angular measurements.

The airliner geometric reference plane 10 (shown in FIG. 6) is computed (step 740), from the geographical positions of the first airliner GPS antenna 11, the second airliner GPS antenna 12, and the third airliner GPS antenna 13. A second set of control laws is executed (step 750) in the airliner-drone aircraft combined flight control system 70, such as in flight control processor A 150 (shown in FIG. 7), in order to stabilize the airliner geometric reference plane 10 to the formation geometric reference plane 50, by for example driving the relative angular rates between these two reference planes to zero.

The drone aircraft geometric reference plane 20 (shown in FIG. 6) is computed (step 745), from the geographical positions of the first drone aircraft GPS antenna 21, the second drone aircraft GPS antenna 22, and the third drone aircraft GPS antenna 23. A third set of control laws is executed (step 755) in the airliner-drone aircraft combined flight control system 70, such as in flight control processor B 250 (shown in FIG. 7), in order to stabilize the drone aircraft geometric reference plane 20 to the formation geometric reference plane 50, by for example driving the relative angular rates between these two reference planes to zero.

In order to continue (step 760) flying in formation, the steps of computing (step 710) the formation centroid 5, computing (step 720) the formation geometric reference plane 50, executing (step 730) the first set of control laws, computing (step 740) the airliner geometric reference plane 10, executing (step 750) the second set of control laws, computing (step 745) the drone aircraft geometric reference plane 20, and executing (step 755) the third set of control laws are repeated at a relatively fast iteration rate, such as for example 20 Hz.

Having now discussed the mechanics of airliner 100 and drone aircraft 200 formation flight in accordance with one aspect my invention, attention is now turned to the missile countermeasures equipment mounted the drone aircraft 200 according to another aspect of my invention.

Figure 9:
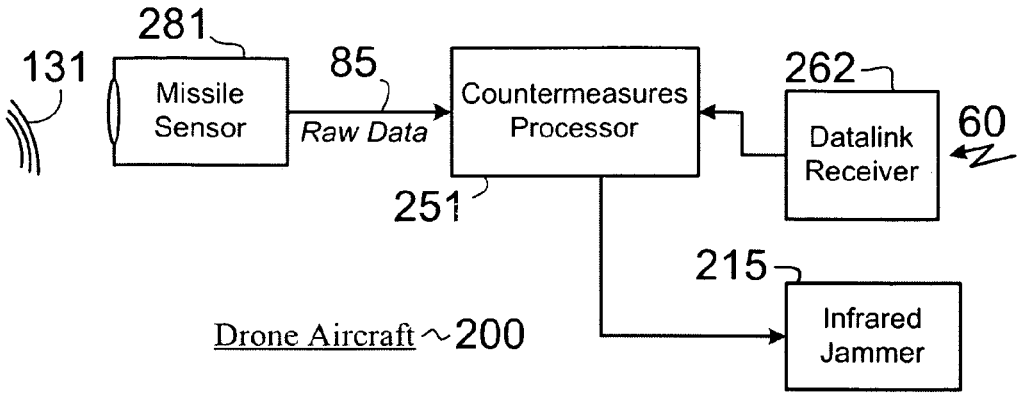
FIG. 9 is a functional block diagram of the missile countermeasures system mounted on the drone aircraft illustrated in FIG. 2.
Figure 10:
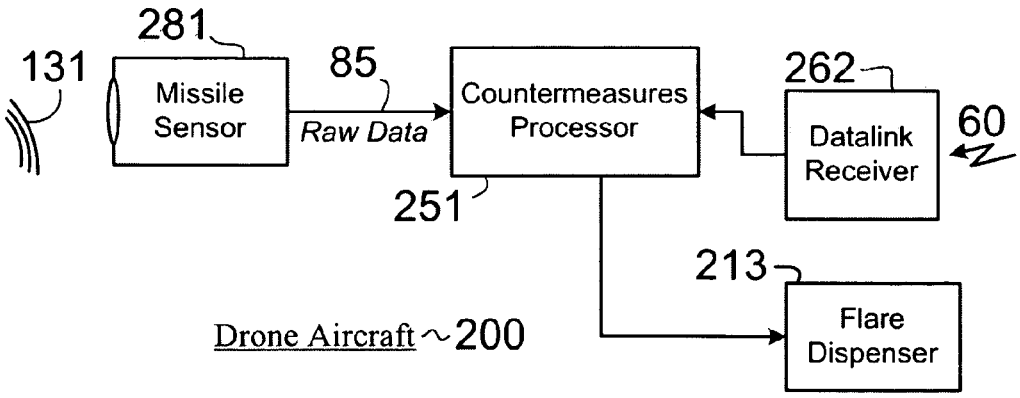
FIG. 10 is a functional block diagram of the missile countermeasures system mounted on the drone aircraft illustrated in FIG. 3.

Refer now to FIGS. 9 and 10, which show drone aircraft missile countermeasures equipment corresponding to the embodiments of my invention shown in FIGS. 2 and 3 respectively.

This formation drone aircraft 200 includes a missile sensor 281 which has the capability to sense the second detectable characteristic 131 associated with missile 130, such as a spectral signature, of the missile 20. Those skilled in the art will recognize that the missile sensor 281 could be configured to sense a wide variation of detectable characteristics including, but not limited to spectral emissions, radar reflections, laser reflections, and radio frequency emanations. Other embodiments of my invention use different variants of missile sensor 281, including software for missile 130 motion detection, such as: a passive infrared-daylight video camera with a fisheye lens, a flying laser spot scanner, or a line laser range finder.

Raw data 85, which includes an indication that missile 130 has been detected is sent from the missile sensor 281 to a countermeasures processor 251 also mounted on the drone aircraft 200. In a further embodiment, the commercial airliner 100, shown in FIG. 1 includes at least one missile sensor and data from that sensor is transmitted to the drone aircraft 200 via the wireless data link 60 where it is used to augment raw data 85 from the drone aircraft missile sensor 281.

Countermeasures processor 251 will issue a command to illuminate an infrared jammer 215 for the first embodiment of my invention shown in FIGS. 2 and 9 or alternatively issue a command for a flare dispenser 213 to dispense flares for the second embodiment of my invention shown in FIGS. 3 and 10.

For the first embodiment, shown in FIGS. 2 and 9, the IR jammer 215 can include a light source that is brighter than the engine IR emissions, illuminate a single IR wavelength illumination source, multiple illumination sources emitting various IR wavelengths, or a light source having the same IR spectrum profile of the airliner engine 115 (shown in FIG. 1).

For the second embodiment, shown in FIGS. 3 and 10, it will be appreciated by those skilled in the art of military aircraft counter-measures that the optimal dispersion pattern of exploded flares 214 to divert an incoming missile is heavily dependent on the configuration of the protected airliner 100.

Figure 11:
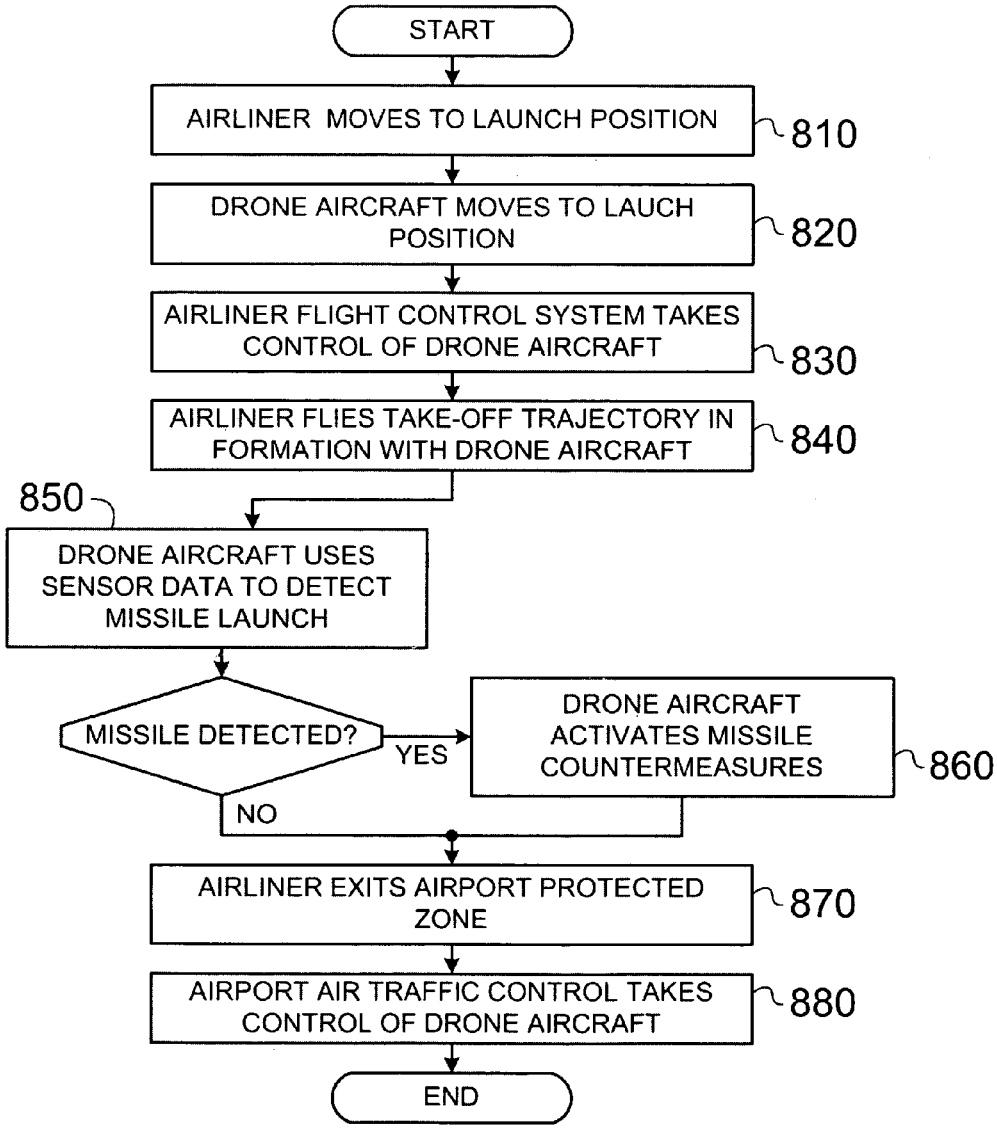
FIG. 11 depicts an illustrative method of protecting commercial airliners from man portable missiles using the system of FIGS. 1-10.

Refer now to FIG. 11, which shows the steps of an illustrative method of protecting commercial airliners from man portable missiles using the system of FIGS. 1-8. The commercial airliner 100 is first moved (step 810) to a first launch position, such as 50 meters from an airport active runway threshold. Next, the drone aircraft is moved (step 820) to a second launch position, such as behind the airliner 100 on the active runway. The airliner 100 flight control system 71 then takes (step 830) control of the drone aircraft flight control system 72 via wireless data link 60, forming an airliner-drone aircraft combined flight control system 70 is then used to control both the airliner 100 and the drone aircraft 200.

Next, the airliner 100 flies (step 840) the takeoff trajectory in formation with the drone aircraft 200, where the mechanics of formation flight in accordance with my invention, are described above. As the airliner 100 flies the take-off trajectory, the missile sensor 281, onboard the drone aircraft 200 senses the presence or absence of the second detectable characteristic 131 associated with the man portable missile 130 to detect (step 850) a missile launch.

If a missile 130 is detected, the drone aircraft activates (step 860) its missile countermeasures equipment, such by transmitting an IR signal as shown in FIGS. 2 and 9 or by dispensing and detonating a flare as shown in FIGS. 3 and 10.

Finally, the airliner 100 exits (step 870) the airport protected zone and airport traffic control (ATC) takes (step 880) control of the drone aircraft so as to return it for use in protecting another airliner. Such an airport protected zone could extend, for example, from 100 feet altitude to 18,000 feet altitude.

LIST OF ACRONYMS USED IN THE DETAILED DESCRIPTION OF THE INVENTION

The following is a list of the acronyms used in the specification in alphabetical order.

ATC airport traffic control
GPS global positioning system
IF intermediate frequency (result of down-converting RF)
IR infrared
RF radio frequency

ALTERNATE EMBODIMENTS

Alternate embodiments may be devised without departing from the spirit or the scope of the invention. For example, the entire drone aircraft 200 could serve as a decoy by allowing itself to be destroyed by a missile 130 containing a contact or proximity fuse.

What is claimed is:

1. A system for protecting an airliner (100) from a missile (130) comprising:

(a) a first flight control system onboard said airliner;

(b) a drone aircraft (200) including a missile sensor (281) adapted to detect the presence of said missile and countermeasures equipment (251) adapted to react to said detected missile;

(c) a second flight control system (72) onboard said drone aircraft;

(d) a wireless link (60) between said first and second flight control systems;

(e) an operational mode under which said first flight control system controls said second flight control system via said wireless link, wherein said wireless link is secure and hardened; and (f) multiple drone aircraft in formation with, and controlled by said airliner.

2. A method for protecting an airliner (100) from a missile (130) by flying a drone aircraft (200) containing countermeasures equipment (251), in formation with said airliner, said method comprising:

(a) computing (step 710) a formation centroid (5) of said formation based on the locations of three GPS antennas (11, 12, and 13), located on said airliner, and the locations of three GPS antennas (21, 22, and 23), located on said drone aircraft;

(b) computing (step 710) a formation geometric reference plane (50) of said formation based on the location of said formation centroid, the location of one GPS antenna located on said airliner, and the location of one GPS antenna located on said drone aircraft;

(c) executing (step 730) a first set of control laws to stabilize said formation geometric reference plane;

(d) computing (step 740) an airliner geometric reference plane (10) based on the locations of said three GPS antennas located on said airliner;

(e) executing (step 750) a second set of control laws to stabilize said airliner reference plane to said formation reference plane;

(f) computing (step 745) a drone aircraft geometric reference plane (20) based on the locations of said three GPS antennas located on said drone aircraft;

(g) executing (step 755) a third set of control laws to stabilize said drone aircraft reference plane to said formation reference plane; and (h) continuing (step 760) formation flight by repeating said steps of computing the formation centroid, computing the formation geometric reference plane, executing the first set of control laws, computing the airliner geometric reference plane, executing the second set of control laws, computing the drone aircraft geometric reference plane, and executing the third set of control laws.

3. The method according to claim 2, wherein said step of executing a second set of control laws to stabilize said airliner reference plane uses locally mounted angular position and rate sensors.

4. A method for protecting an airliner (100) from a missile (130) by flying a drone aircraft (200) containing countermeasures equipment (251), in formation with said airliner, said method comprising:

(a) moving (step 810) said airliner to a first launch position;

(b) moving (step 820) said drone aircraft to a second launch position;

(c) taking (step 830) control of a drone aircraft flight control system (72) by an airliner flight control system (71) and forming an airliner-drone aircraft combined flight control system (70);

(d) flying (step 840) said airliner and said drone aircraft on a takeoff trajectory and in formation, under the control of said airliner-drone aircraft combined flight control system;

(e) detecting (step 850) a missile launch using a missile sensor (281) onboard said drone aircraft;

(f) activating (step 860) missile countermeasures equipment, onboard said drone aircraft, when said missile is detected;

(g) exiting (step 870) said aircraft from an airport protected zone; and (h) taking (step 880) control of the drone aircraft by airport air traffic control.

5. The method according to claim 4, wherein said step of detecting a missile launch is performed by motion detection software.

6. The method according to claim 4, wherein said step of activating missile countermeasures equipment further comprises illuminating an IR jammer.

7. The method according to claim 4, wherein said step of activating missile countermeasures equipment further comprises dispensing flares.

8. The method according to claim 4, wherein said airport protected zone extends from 100 feet altitude to 18,000 feet altitude.

9. A system for protecting an airliner from a missile comprising:

an aircraft comprising:

a first plurality of control surfaces adapted to be disposed in a range of positions;

a first plurality of GPS antennas, at least two of the GPS antennas each coupled to one of the first plurality of control surfaces;

a first flight control system coupled to the first plurality of GPS antennas and adapted to determine the position of each of the first plurality of GPS antennas and transmit a first signal, the signal containing information related to the position of each of the first plurality of GPS antennas; and a first wireless transceiver coupled to the first flight control system, adapted to transmit and receive data; and a drone aircraft comprising:

a second plurality of control surfaces adapted to be disposed in a range of positions;

a second plurality of GPS antennas, at least two of the GPS antennas each coupled to one of the second plurality of control surfaces;

a second flight control system coupled to at least one of the second plurality of GPS antennas and adapted to position at least two of the second plurality of control surfaces in response to the first signal;

a second wireless transceiver coupled to the second flight control system and adapted to transmit and receive data, the second wireless transceiver linked to the first wireless transceiver;

a missile sensor coupled to the second flight control system and adapted to detect an incoming missile and transmit a second signal; and a countermeasure adapted to be deployed in response to the second signal.

10. The system of claim 9, wherein the first signal is transmitted by the first wireless transceiver and received by the second wireless transceiver.

11. The system of claim 9, wherein the link between the first and second wireless transceivers is secure and hardened.

12. The system of claim 9, wherein the first plurality of GPS antennas are disposed in positions which forms a plane.

13. The system of claim 12, wherein each of the disposed GPS antennas is more than 5 meters from any other disposed GPS antenna.

14. The system of claim 12, wherein the first flight control system is adapted to determine a plane from the positions of the first plurality of GPS antennas.

15. The system of claim 14, wherein the first flight control system is further adapted to include information describing the plane in the first signal.

16. The system of claim 15, wherein the second plurality of GPS antennas are disposed in positions which forms a plane.

17. The system of claim 16, wherein the second flight control system is adapted to adjust the second plurality of flight control surfaces in response to the first signal.

18. The system of claim 9, wherein the countermeasure comprises a flare dispenser.

19. The system of claim 9, wherein the countermeasure comprises a radar emitter adapted to transmit false returns signals.

20. The system of claim 9, wherein the missile sensor comprises a sensor adapted to detect at least one of spectral emissions, radar reflections, laser reflections, and radio frequency emanations.

* * * * *